United States Patent [19]

Kleinevoss et al.

[11] Patent Number: 4,842,172

[45] Date of Patent: Jun. 27, 1989

[54] COMPOSITE REFRACTORY MEMBER

[75] Inventors: Albert Kleinevoss, Höhr-Grenzhausen; Jochen Kopia, Bendorf, both of Fed. Rep. of Germany

[73] Assignee: Didier-Werke AG, Wiesbaden, Fed. Rep. of Germany

[21] Appl. No.: 38,824

[22] Filed: Apr. 15, 1987

[30] Foreign Application Priority Data

Apr. 30, 1986 [DE] Fed. Rep. of Germany ..... 3614730

[51] Int. Cl.[4] ..... B22D 41/08

[52] U.S. Cl. ..... 222/600; 266/287

[58] Field of Search ..... 266/236, 272, 280, 285, 266/286, 287; 222/590, 591, 600, 598, 601, 599, 597

[56] References Cited

U.S. PATENT DOCUMENTS

| | | | |
|---|---|---|---|
| 4,314,659 | 2/1982 | Shapland | 222/590 |
| 4,586,699 | 5/1986 | Bachmann et al. | 266/287 |
| 4,717,128 | 1/1988 | Brückner et al. | 266/287 |
| 4,728,013 | 3/1988 | Winkelmann et al. | 266/236 |

FOREIGN PATENT DOCUMENTS

| | | | |
|---|---|---|---|
| 2624299 | 12/1976 | Fed. Rep. of Germany . | |
| 2719105 | 11/1978 | Fed. Rep. of Germany . | |
| 3538499 | 5/1987 | Fed. Rep. of Germany | 222/600 |

OTHER PUBLICATIONS

*Special Refractories*, Henson, American Foundryman, pp. 64–70, 5/47.

*Primary Examiner*—Scott Kastler

*Attorney, Agent, or Firm*—Wenderoth, Lind & Ponack

[57] ABSTRACT

A composite refractory member includes at least one insert formed of an oxide ceramic material having a high resistance to molten material. The insert defines a discharge opening or other molten material contacting surface. A base structure encloses and supports the insert and is formed by molding a chemically setting refractory concrete including a refractory granulate of low-iron sintered magnesia with a MgO content of over 80 weight percent. Mold cores extend into the refractory concrete during molding such that the molded structure has expansion joints which later are filled with mortar.

11 Claims, 1 Drawing Sheet

COMPOSITE REFRACTORY MEMBER

BACKGROUND OF THE INVENTION

The present invention relates to a composite refractory member having therethrough a discharge opening and for use in discharging molten material, particularly molten metal, from a vessel, particularly a metallurgical vessel. The present invention particularly is directed to such a refractory member which may be employed as a movable or stationary plate assembly in a sliding closure unit, or as an inlet or outlet nozzle in such sliding closure unit. More particularly, the present invention is directed to such a refractory member of the type having at least one insert which at least partially defines the discharge opening of the refractory member and which is formed of an oxide ceramic material having a high resistance to the molten material, and a refractory base structure enclosing and supporting the insert.

Furthermore, the present invention is directed to a method for the formation of such a refractory member.

West German DE-AS No. 27 19 105 discloses a refractory plate assembly including an oxide ceramic insert enclosed by a refractory base structure of refractory concrete. The insert is of an oxide ceramic material particularly adapted to withstand the molten metal, and particularly the insert is formed of MgO, $Cr_2O_3$, $Al_2O_3$ or $ZrO_2$ or a mixture of such oxides. On the other hand, the refractory concrete of the base structure is composed of 70 to 95 weight percent tabular alumina and 5 to 30 weight percent of alumina cement with a content of 80 to 96 weight percent of $Al_2O_3$.

This and similar alumina compositions are employed for the refractory concrete due to the relatively high thermal shock resistance of such materials. However, the use of such refractory concrete compositions has certain inherent disadvantages. Thus, such materials have low corrosion resistance to molten metals, and this is a problem when a molten metal contacts a base structure formed of such composition. This can occur, for example, when the two plates of a sliding closure unit are formed of composite refractory members. Specifically, it can occur that the molten metal will penetrate between the two plates and come into contact with the base structures. Further, such alumina compositions have relatively low friction resistance.

In view of the above disadvantages of conventional alumina compositions, it would be desirable to form the base structure of a refractory concrete having greater abrasion resistance and resistance to erosion by molten metal. However, refractory concretes of such type, for example magnesia, have a relatively low thermal shock resistance and therefore have been considered to be too brittle for use as a refractory concrete for forming a base structure of a composite refractory member of this type.

SUMMARY OF THE INVENTION

Accordingly, it is an object of the present invention to provide such a composite refractory member including at least one insert formed of an oxide ceramic material having high resistance to the molten metal and a base structure enclosing and supporting the insert and being formed of a refractory concrete having greater durability, abrasion resistance and erosion resistance than materials employed in the past. It is a more specific object of the present invention to employ materials of a type which have been considered in the past to be unsuitable for such purpose due to relatively low thermal shock resistance and brittleness, by employing a particular composition of such materials combined with an alteration of the base structure to compensate for such undesirable property.

It is a further object of the present invention to provide a method for the formation of such specific composite refractory member.

These objects of the present invention are achieved in the following manners.

Thus, the composite refractory member of the present invention includes at least one insert at least partially defining the discharge opening of the refractory member and formed of an oxide ceramic material having a high resistance to the molten metal. The base structure enclosing and supporting the insert is formed of a chemically setting refractory concrete including a refractory granulate of low-iron sintered magnesia with a MgO content of over 80 weight percent. The base structure has therein at least one expansion joint which is filled with mortar, the expansion joint being positioned and extending in directions to minimize the relatively low thermal shock resistance of the magnesia material. Particularly, the expansion joint extends in a direction generally parallel to the axis of the discharge opening. After the chemically setting refractory concrete of this composition has set, and after heat treatment of the refractory member, mortar is filled into the expansion joint, and such mortar may be of the same composition as the refractory concrete material employed for the base structure.

As a result of the use of the above magnesia refractory concrete, it is possible to impart to the base structure a greater durability than has been possible in the past, particularly when the refractory members are employed as plates in a sliding closure unit, since any molten metal penetrating between the plates and reaching the surface of the base structure over the insert during operation of the sliding closure unit will cause less corrosive and erosive damage to the base structure than has occurred in accordance with prior art arrangements. Further, the base structure of sintered magnesia according to the present invention is extremely resistant to any damaging frictional forces that might occur between the two plates due to freezing therebetween of the metal. The use of a refractory concrete with sintered magnesia as a refractory granulate is possible without the risk of stress cracks due to the relatively low thermal shock resistance of the magnesia due to the provision of the system of expansion joints. Particularly, the expansion joints counteract the relatively low thermal shock resistance of the magnesia material and prevent stress cracks which otherwise would occur during heat treatment of the plate after the base structure has set or dried. It is only the combined effect of the use of the particular sintered magnesia material with the provision of the expansion joints which makes possible the improved composite refractory member of the present invention. As a result, there is uniform wear of the base structure and the oxide ceramic insert, thereby increasing the useful life of the refractory member. Particularly, it is possible to use a refractory member according to the present invention for a longer time for a greater number of molten metal discharge operations, thereby making the refractory member more cost competitive.

The refractory material employed for the base structure of the present invention is a refractory concrete which is chemically setting (in a manner known in the art) and which includes a refractory granulate of low-iron sintered magnesia with a MgO content of over 80 weight percent. As employed herein the term "low-iron" is intended to indicate, as would be understood by those skilled in the art, that the sintered magnesia is very pure, for example sea water magnesia, i.e. recovered from sea water by treatment with slaked lime or slightly calcined dolomite having an iron content of no more than approximately 0.5 weight percent. One example of the overall composition of the sintered magnesite according to the present invention, in approximate values, is 97 weight percent MgO, 2 weight percent CaO, 0.2 weight percent $Fe_2O_3$ and 0.8 weight percent residual oxide. It is not intended however that this specific composition be limiting of the scope of the present invention, and those skilled in the art would understand from the present disclosure other compositions that may be employed, the important limitations being that the sintered magnesia of the refractory granulate have a low iron content and a MgO content of over 80 weight percent.

The present invention particularly is useful as a composite refractory member in the from of a plate for a sliding closure unit, since such members are subjected to particularly harsh operating conditions. Although the operating conditions for inlet and outlet sleeves or nozzles of sliding closure units are not as severe, the concept of the present invention equally applies to composite refractory members of such type, since the durability of such sleeves or nozzles is increased according to the present invention.

In accordance with the method aspect of the present invention, the oxide ceramic insert is positioned within a mold such that there is a space defined between the insert and the mold. At least one mold cure is extended from the mold into the space to form the expansion joint. The chemically setting refractory concrete of the above composition is filled into the space, and the refractory concrete is set chemically (as is known in the art), thereby forming the base structure enclosing and supporting the insert. The thus, formed refractory member is removed from the mold, and the mold core is removed from the refractory concrete, thereby forming the expansion joint in the base structure. After heat treatment of the refractory member, the expansion joint is filled with refractory mortar, which can be of the same composition as that of the refractory concrete.

Advantageously, the mold core is wedge-shaped with a wider end directed toward the mold. As a result, the expansion joint will be formed wedge-shaped with a wider end at a surface of the base structure or refractory member. This facilitates the removal of the mold core from the base structure after setting thereof.

When the composite refractory member is in the form of a refractory plate assembly for a sliding closure unit, and particularly wherein such assembly has two spaced long sides, then preferably at least one expansion joint is provided at approximately the middle of each long side, with each expansion joint extending longitudinally at a right angle to such long side across the entire width or dimension of the base structure at such position. Further, the expansion joint extends into the base structure for a depth at least equal to the thickness of the insert. It is to be understood that additional expansion joints may be provided in the base structure around the periphery of the insert at suitable locations as necessary to counteract the development of thermal stress cracks, as would be understood by one skilled in the art for a particular structural configuration. Further, it is possible for the expansion joints to extend to a depth throughout the thickness of the base structure.

When the composite refractory member is in the form of an inlet or outlet sleeve or nozzle for a sliding closure unit, then the insert is in the form of a tube or a sleeve and the base structure also is in the form of a tube or a sleeve surrounding the insert. In such situation, the expansion joint has a longitudinal direction parallel to the axis of the sleeves and has a depth in a radial direction of the sleeves. The expansion joint may extend entirely through the thickness of the base structure or through only a portion thereof. Further, a plurality of expansion joints may be spaced around the periphery of the tube or sleeve-shaped base structure and may have depths extending less than the thickness thereof.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
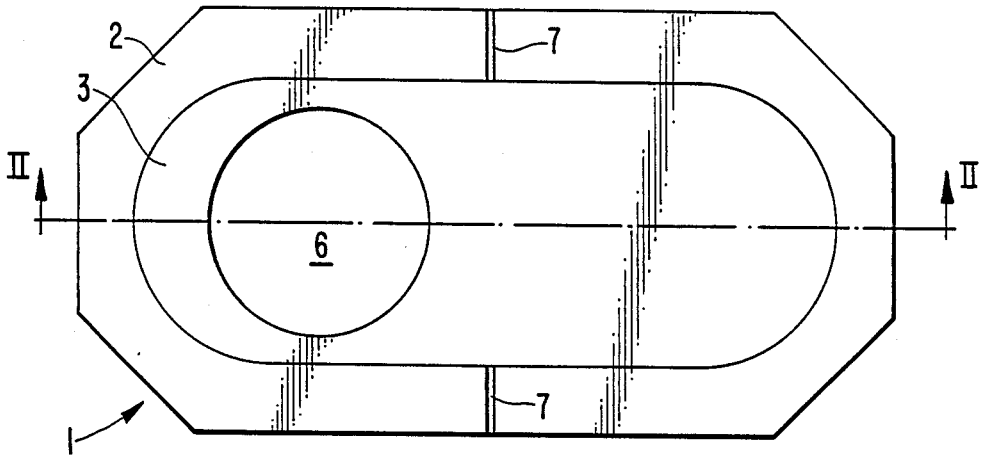
FIG. 1 is a plan view of a composite refractory member according to a first embodiment of the present invention and specifically in the form of a movable plate assembly for use in a sliding closure unit.
Figure 2:
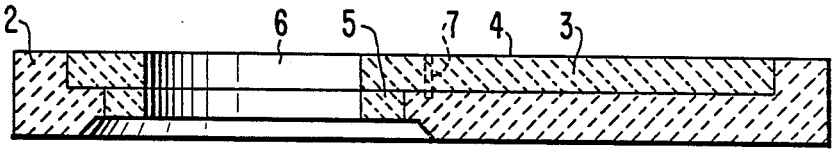
FIG. 2 is a sectional view taken along line II—II of FIG. 1.

FIGS. 1 and 2 illustrate a composite refractory member in the form of a movable refractory plate assembly 1 for use in a sliding closure unit of the rectilinearly movable type. The assembly 1 has spaced, parallel long sides and includes a plate-shaped insert 3 forming a sliding surface 4 of the plate assembly 1. A ring-shaped insert 5 abuts insert 3, and the two inserts have therethrough openings defining a discharge opening 6 through the plate assembly. Inserts 3, 5 are formed in a known manner of an oxide ceramic material having a high resistance to the molten material, for example metal, to be discharged. Inserts 3, 5 are fabricated of such oxide ceramic material, for example a highly refractory oxide such as zirconium oxide, as would be understood by one skilled in the art.

Figure 3A:
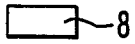
FIGS. 3A and 3B are detailed views of a mold core employed to form an expansion joint in the embodiment of FIGS. 1 and 2.

After any necessary adjustments of inserts 3, 5 the inserts are positioned within a mold, and around such inserts is molded a cold chemically setting refractory concrete, for example pourable or vibratable, to form a base structure 2 enclosing and supporting the inserts. The refractory concrete includes a refractory granulate of low-iron sintered magnesia with a MgO content of over 80 weight percent. Extending into the space filled by the refractory concrete are mold cores, for example as shown at 8 in FIGS. 3A and 3B. The refractory concrete is chemically set, as would be understood by one skilled in the art, for example with the addition of phosphate. After setting, the resultant formed composite refractory member 1 is removed from the mold. Mold cores 8 are removed, such that expansion joints 7 are formed in the base structure 2. The combination of the use of the particular refractory concrete and the provision of the expansion joints makes possible the use for the base structure of a material having high durability, abrasion resistance and erosion resistance, without concern for the formation of thermal stress cracks in such material.

Figure 3B:
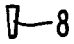

As shown in FIGS. 1 and 2, expansion joints 7 are formed at approximately the middle of each long side of the refractory member 1, and each expansion joint 7 has a longitudinal direction extending at a right angle to such long side. As shown in FIG. 2, each expansion joint 7 has a depth extending into base structure 2 at least equal to the thickness of plate-shaped insert 3. The wedge-shape of the mold cores 8, as shown in FIG. 3B, facilitates removal of the mold cores from the set refractory concrete of base structure 2. The expansion joints 7 avoid thermal stresses in the base structure that lead to cracks during the heat treatment of the assembly 1. Following the heat treatment of base structure 2, which essentially is a tempering operation, the expansion joints 7 are filled and sealed with a refractory mortar which is smooth. Filling of the expansion joints is facilitated by the wedge shape thereof. The refractory mortar may be material of the same composition as the refractory concrete of the base structure. FIG. 2 shows the expansion joints 7 extending from the level of sliding surface 4 into the base structure 2 for a depth at least equal to the thickness of plate insert 3. Expansion joint 7 however could extend to a deeper depth or entirely through the thickness of the base structure. Further, additional joints other than the two joints shown in FIG. 1 could be provided around the circumference of the assembly.

Figure 4:
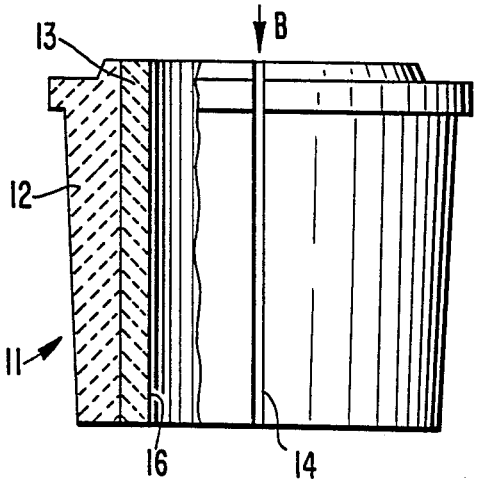
FIG. 4 is an elevation view, partially in section, of a composite refractory member according to another embodiment of the present invention and specifically in the form of an outlet nozzle for use in a sliding closure unit, and specifically adapted for use with the plate assembly of FIGS. 1 and 2.
Figure 5:
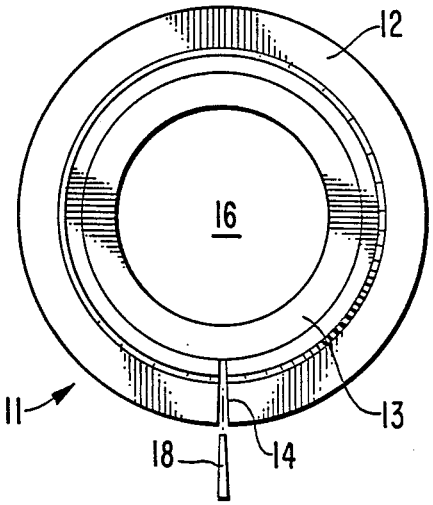
FIG. 5 is a top plan view of the number shown in FIG. 4, taken in the direction of arrow B thereof.

FIGS. 4 and 5 illustrate the features of the present invention applied to a composite refractory member in the form of an outlet nozzle 11 for example intended for use with the plate assembly 1 of FIGS. 1 and 2. Thus, the highly erosion resistant insert is in the form of a sleeve 13, and the base structure 12 also is in the form of a sleeve surrounding insert 13. Sleeve insert 13 defines discharge opening 16, for example aligned with discharge opening 6 of plate assembly 1 during assembly and use of a sliding closure unit. The base structure 12 of FIGS. 4 and 5 is formed of the same material as base structure 2 discussed above. An expansion joint 14 has a longitudinal dimension extending parallel to the axis of discharge or outlet opening 16, and as shown in FIG. 5, expansion joint 14 extends radially thereof. Also illustrated is the fact that expansion joint 14 is wedge-shaped, as formed by mold core 18 and is removed radially from set base structure 12. FIG. 5 illustrates a single expansion joint 14 extending entirely through the thickness of base structure 12. Alternatively, depending upon the particular installation, and as would be understood by one skilled in the art, a plurality of expansion joints may be spaced around the circumference of the base structure, and such expansion joints can be provided to have smaller radial depths of penetration into the base structure.

Figure 6:
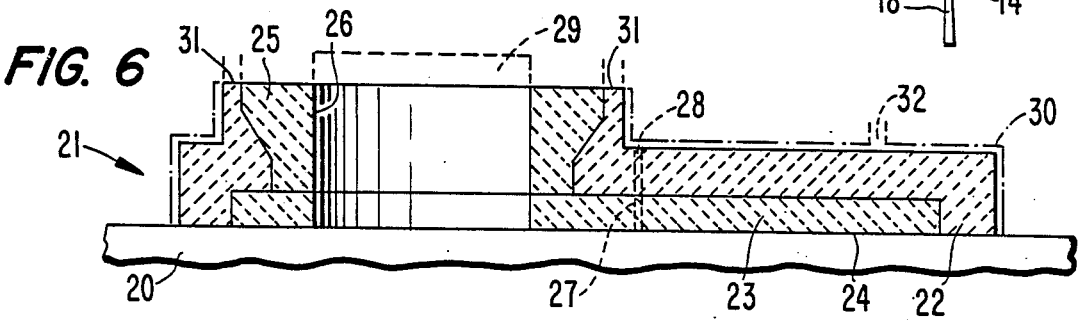
FIG. 6 is a cross-sectional view of a composite refractory member according to a further embodiment of the present invention, and particularly in the form of a stationary refractory plate assembly for use in a sliding closure unit, and also schematically illustrating a mold employed for the formation thereof.

FIG. 6 illustrates a composite refractory member 21 in the form of a bottom or stationary plate assembly for use in a sliding closure unit. Assembly 21 includes a plate-shaped insert 23, a generally tubular shaped insert 25, the two inserts together defining a discharge opening 26, and a base structure 22 enclosing and supporting the inserts. Assembly 21 has two long sides, in approximately the middle of each of which is formed an expansion joint 27. Expansion joint 27 is formed similar to the manner discussed above regarding the embodiment of FIGS. 1 and 2, except FIG. 6 illustrates the expansion joint as extending through the entire thickness of the base structure.

In all of the above embodiments of the present invention, the expansion joints 7, 14, 27 are filled with a refractory mortar after heat treatment, i.e. tempering, of the assemblies in a manner which would be understood by one skilled in the art, for example for approximately twelve hours at a temperature of 250° to 300° C.

The thickness of the expansion joints 7, 14, 27, their formation and arrangement in the particular refractory shapes, such as 1, 11, 21, depend substantially on the shape and size of the refractory assembly. For example, in relatively large format plate assemblies, for example for sliding closure units for furnaces, a thickness of the expansion joints of from 3 to 4 mm has proven to be appropriate. This is exemplary however, and one skilled in the art would understand how to select a suitable joint shape, thickness and location for a particular installation.

FIG. 6 further illustrates, somewhat schematically, the method of the present invention for the formation of the composite refractory member 21. Thus, initially plate-shaped insert 23, for example prefabricated from zirconium oxide, is placed with sliding surface 24 on a smooth backing plate 20 of a mold. An aligning member 29 of the mold is employed to align the discharge openings 26 in plate-shaped insert 23, and ring-shaped insert 25 is positioned thereon or built up, in a manner as would be understood by one skilled in the art. Mold 30 then is positioned over the assembly to define a space between inserts 23, 25 and mold 30. It will be understood that mold 30 may be provided to allow for adjustment in a known manner. Extending into the space from the inside of mold 30 along the long sides are opposing wedge-shaped mold cores 28. The refractory concrete discussed above then is filled into the space through suitable fill openings, such as shown schematically at 31 and 32. Specifically, the above discussed refractory concrete may include a phosphate binder, and after the filled refractory concrete has set, the resultant assembly 21 is removed from the mold. The mold cores 28 are removed, and after heat treatment the expansion joints 27 are filled by refractory mortar.

Although the present invention has been described and illustrated with respect to preferred features thereof, it is to be understood that various changes and modifications may be made to the specifically described and illustrated features without departing from the scope of the present invention.

We claim:

1. A refractory member having therethrough a discharge opening and for use in discharging molten metal from a metallurgical vessel, said refractory member comprising:

at least one insert at least partially defining said discharge opening and formed of an oxide ceramic material having resistance to the molten metal;

a base structure enclosing and supporting said insert, said base structure being formed of a chemically setting refractory concrete including a refractory granulate of low-iron sintered magnesia with a MgO content over 80 weight percent; and said base structure having therein means for preventing said base structure from stress cracking due to thermal shock, said means comprising at least one expansion joint filled with mortar.

2. A member as claimed in claim 1, wherein said expansion joint is wedge-shaped with a wider end at a surface of said base structure.

3. A member as claimed in claim 1, comprising a refractory plate assembly for use in a sliding closure unit.

4. A member as claimed in claim 3, wherein said assembly has spaced long sides, and comprising a said expansion joint provided at approximately the middle of each said long side, said expansion joints extending at right angles to respective said long sides.

5. A member as claimed in claim 4, wherein each said expansion joint has a depth in said base structure at least equal to the thickness of said insert.

6. A member as claimed in claim 1, comprising a nozzle for use in a sliding closure unit, and said insert is in the form of a sleeve, said base structure is in the form of a sleeve surrounding said insert, and said expansion joint extends radially of said sleeves.

7. A member as claimed in claim 6, wherein said expansion joint extends entirely through the thickness of said base structure.

8. A member as claimed in claim 1, wherein said mortar is formed of material of the composition of said refractory concrete of said base structure.

9. A member as claimed in claim 1, wherein said expansion joint is spaced from said discharge opening.

10. A member as claimed in claim 1, wherein said expansion joint extends through a portion only of the thickness of said base structure.

11. A member as claimed in claim 1, wherein said base structure is of integral one-piece construction.

* * * * *